US010665981B2

(12) United States Patent
Mossig et al.

(10) Patent No.: US 10,665,981 B2
(45) Date of Patent: May 26, 2020

(54) MODULAR HOLDING FRAME FOR PLUG CONNECTORS

(71) Applicant: HARTING Electric GmbH & Co. KG, Espelkamp (DE)

(72) Inventors: Mirko Mossig, Bielefeld (DE); Andre Tiemann, Bad Essen (DE); Heiko Meier, Minden (DE); Michael Przyborowski, Bielefeld (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/180,896

(22) Filed: Nov. 5, 2018

(65) Prior Publication Data

US 2019/0140388 A1 May 9, 2019

(30) Foreign Application Priority Data

Nov. 6, 2017 (DE) ..... 10 2017 125 859

(51) Int. Cl.

| | |
|---|---|
| ***H01R 13/502*** | (2006.01) |
| ***H01R 13/518*** | (2006.01) |
| *H01R 13/514* | (2006.01) |
| *H01R 13/512* | (2006.01) |
| *H01R 13/652* | (2006.01) |

(52) U.S. Cl.

CPC ..... *H01R 13/518* (2013.01); *H01R 13/502* (2013.01); *H01R 13/512* (2013.01); *H01R 13/514* (2013.01); *H01R 13/652* (2013.01)

(58) Field of Classification Search

CPC .. H01R 13/518; H01R 13/502; H01R 13/512; H01R 13/514; H01R 13/652

USPC ..... 439/701

See application file for complete search history.

(56) References Cited

U.S. PATENT DOCUMENTS 5,385,490 A * 1/1995 Demeter ..... H01R 9/038 439/289
6,004,162 A * 12/1999 Harting ..... H01R 13/518 439/532
6,196,869 B1 * 3/2001 Kay ..... H01R 9/2441 439/532

(Continued)

FOREIGN PATENT DOCUMENTS

CN 104466562 A 3/2015
DE 296 01 998 U1 5/1996

(Continued)

OTHER PUBLICATIONS

German Office Action, dated Sep. 14, 2018, for German Application No. 10 2017 125 859.0, 8 pages.

(Continued)

*Primary Examiner* — Abdullah A Riyami
*Assistant Examiner* — Vladimir Imas
(74) *Attorney, Agent, or Firm* — Seed IP Law Group LLP

(57) ABSTRACT

A holding frame for plug connectors, in particular for receiving similar and/or different plug connector modules, is provided wherein the holding frame comprises or consists substantially of a plurality of holding frame modules. The holding frame is utilized first and foremost in applications in which a certain stability is certainly necessary but no particularly high mechanical plug loads occur. In addition, the holding frame is usable flexibly and is adaptable to user requirements.

16 Claims, 3 Drawing Sheets

(56) References Cited

U.S. PATENT DOCUMENTS

| | | | | |
|---|---|---|---|---|
| 7,316,578 | B2 * | 1/2008 | Ono | G01R 31/2889 385/59 |
| 7,316,591 | B2 * | 1/2008 | Ferderer | H01R 13/506 439/532 |
| 7,322,842 | B2 * | 1/2008 | Duck | G02B 6/381 200/51.03 |
| 9,257,788 | B1 * | 2/2016 | Jia | H01R 13/518 |
| 9,577,365 | B1 * | 2/2017 | Herbrechtsmeier | H01R 13/518 |
| 9,847,608 | B2 * | 12/2017 | Bruex | H01R 13/514 |
| 9,972,938 | B2 * | 5/2018 | Imai | H01R 13/514 |
| 10,177,484 | B2 * | 1/2019 | Schonfeld | H01R 13/518 |
| 10,249,978 | B2 * | 4/2019 | Dean | H01R 13/504 |
| 2003/0194914 | A1 | 10/2003 | Duck et al. | |
| 2007/0155252 | A1 | 7/2007 | Ferderer | |
| 2011/0217880 | A1 | 9/2011 | Schmidt et al. | |
| 2012/0244754 | A1 | 9/2012 | Riepe et al. | |
| 2015/0199603 | A1 | 7/2015 | Troeger et al. | |
| 2015/0280351 | A1 | 10/2015 | Bertsch | |
| 2016/0093980 | A1 | 3/2016 | Beischer et al. | |
| 2016/0276778 | A1 | 9/2016 | Beischer et al. | |
| 2018/0026405 | A1 | 1/2018 | Schlepp et al. | |
| 2018/0248296 | A1 | 8/2018 | Herbrechtsmeier et al. | |
| 2018/0254578 | A1 | 9/2018 | Herbrechtsmeier et al. | |
| 2019/0229457 | A1 | 7/2019 | Herbrechtsmeier et al. | |

FOREIGN PATENT DOCUMENTS

| | | | |
|---|---|---|---|
| DE | 20 2010 009 119 | U | 9/2010 |
| DE | 20 2011 050 643 | U1 | 10/2011 |
| DE | 20 2013 103 611 | U1 | 11/2013 |
| DE | 10 2012 107 270 | A1 | 2/2014 |
| DE | 10 2012 110 907 | A1 | 5/2014 |
| DE | 10 2013 106 279 | A1 | 12/2014 |
| DE | 10 2013 113 975 | A1 | 6/2015 |
| DE | 10 2015 104 562 | A1 | 9/2016 |
| DE | 10 2013 113 976 | B4 | 10/2016 |
| DE | 10 2015 114 696 | A1 | 3/2017 |
| DE | 10 2015 114 703 | A1 | 3/2017 |
| DE | 10 2016 213 286 | A1 | 1/2018 |
| EP | 1 026 788 | A1 | 8/2000 |
| EP | 1 353 412 | A2 | 10/2003 |
| EP | 0 860 906 | B1 | 5/2004 |
| EP | 1 801 927 | B1 | 5/2010 |
| EP | 2 312 700 | A1 | 4/2011 |
| EP | 3 067 993 | A1 | 9/2016 |
| WO | 2011/069521 | A1 | 6/2011 |
| WO | 2011/069522 | A1 | 6/2011 |
| WO | 2014/072005 | A1 | 5/2014 |
| WO | 2014/155171 | A1 | 10/2014 |
| WO | 2016/124173 | A1 | 8/2016 |
| WO | 2018/015045 | A1 | 1/2018 |

OTHER PUBLICATIONS

European Office Action, dated Nov. 14, 2019, for European Application No. 18 000 826.0-1201, 5 pages.

European Office Action, dated Nov. 27, 2018, for European Application No. 18 000 826.0-1201, 7 pages.

* cited by examiner

MODULAR HOLDING FRAME FOR PLUG CONNECTORS

BACKGROUND

Technical Field

The disclosure relates to a modular holding frame for plug connectors, in particular for receiving similar and/or different plug connector modules.

Such plug connector modules are required as component parts of a plug connector modular system in order to be able to adapt a plug connector, in particular a heavy rectangular plug connector, flexibly to certain demands with reference to signal and power transmission, for example between two electric devices. For this purpose, plug connector modules are usually inserted into corresponding plug connector module frames, which are also sometimes designated as holding frames, articulated frames, module frames or modular frames. The plug connector modular frames consequently serve for the purpose of receiving multiple plug connector modules that are similar and/or also different to one another and of fastening them securely on a surface and/or in a plug connector housing or the like.

Each plug connector module has, as a rule, a substantially cuboid insulating body. Said insulating bodies can serve, for example, as contact carriers and receive and fix contacts of the most varied kinds. The role of a plug connector formed as a result is therefore very flexible. For example, pneumatic modules, optical modules, modules for transmitting electric power and/or electric analog and/or digital signals can be received in the respective insulating body and thus be used in the plug connector modular system. Plug connector modules increasingly also take over measuring and data tasks.

Description of the Related Art

Said plug connector modular systems with such plug connector modules using such a plug connector module frame, also known as holding frames, module frames, articulated frames or modular frames, are disclosed in the prior art in numerous pamphlets and publications, presented at trade fairs and are frequently used in the industrial sphere in the form of heavy-duty plug connectors. They are described, for example, in the publications DE 10 2013 106 279 A1, DE 10 2012 110 907 A1, DE 10 2012 107 270 A1, DE 20 2013 103 611 U1, EP 2 510 590 A1, EP 2 510 589 A1, DE 20 2011 050 643 U1, EP 0 860 906 A2, DE 29 601 998 U1, EP 1 353 412 A2, DE 10 2015 104 562 A1, EP 3 067 993 A1, EP 1 026 788 A1, EP 2 979 326 A1 and EP 2 917 974 A1.

Said publication EP 0 860 906 B1 discloses a plug connector modular frame in the form of an articulated frame for mounting plug connector modules and for installing them in a plug connector housing or for screw-connecting them onto wall surfaces. In this case, the plug connector modules are inserted in the plug connector modular frames. Mounting means, which interact with windows provided on opposite side parts of the plug connector modular frame, are provided on the plug connector modules, the windows consisting of recesses which are realized as openings that are closed on all sides in the side parts of the plug connector modular frame.

The plug connector modular frame, in the realization as an articulated frame, consists of two frame halves which are connected together in an articulated manner, the separation of the plug connector modular frame being provided transversely to the side parts of the frame. Joints are arranged in the fastening ends of the plug connector modular frame such that, when the plug connector modular frame is screwed onto a fastening surface, the side parts are aligned at right angles to the fastening surface, as a result of which the plug connector modules enter into a positive locking connection to the plug connector modular frame via the mounting means. In practice, such plug connector modular frames are usually produced in a die casting process, in particular in a zinc die casting process.

Publication DE 10 2015 114 703 A1 discloses a further development of such a plug connector modular frame which is designed as an articulated frame. The plug connector modular frame disclosed therein comprises at least one fixing means by means of which the frame halves are fixable in relation to one another in two positions, an open position and a closed position, which facilitates handling in a considerable manner.

Publication DE 20 2013 103 611 U1 shows two frame halves which can be screw-connected to one another in an extremely sturdy manner, are producible in a cost-efficient manner using punching and bending technology, can be screwed together and are suitable for receiving, among other things, pneumatic modules. The plug connector modular frame mounted in this manner also only comprises very low creeping properties under high mechanical long-term load. However, a disadvantage is that the cost of adding or replacing a plug connector module is extremely high.

It has been shown in practice, however, that such plug connector modular frames require complex operation for assembly.

Publication EP 1 801 927 B1 discloses a one-part plug connector modular frame which consists of plastics material. The plug connector modular frame is realized as a circumferential collar and comprises on its plug side multiple wall segments which are separated by slots. In each case, two oppositely situated wall segments form an insertion region for a plug connector module, the wall segments comprising window-like openings which serve for receiving projections which are integrally molded on the narrow sides of the modules. In addition, a guide groove is provided in each wall section. The guide groove is formed above the openings by means of a window web which is offset to the outside and comprises a lead-in chamfer on the inside surface. The plug connector modules additionally comprise latching arms, which are integrally molded on the narrow sides acting in the direction of the cable connections and latch below the side collar wall such that two independent latching means fix the plug connector modules in the plug connector modular frame.

Publication DE 10 2013 113 976 B4 discloses a plug connector modular frame for a heavy plug connector for receiving similar and/or different plug connector modules. The plug connector modular frame consists of a base frame which is rectangular in cross section and comprises two oppositely situated side parts. A framing part, consisting of a flexible material, in particular spring-elastic sheet metal, is attached to each of the side parts. When a plug connector module is inserted into the plug connector modular frame perpendicularly to the frame plane, said framing parts are initially bent outward away from the side part. The framing parts can have, in particular, tabs with latching windows which are suitable for latching the plug connector modules individually to the latching lugs thereof in the plug connector modular frame. The plug connector modules can consequently be inserted from the cable connection direction and in the plugging direction individually and with only a small effort into the plug connector modular frame and can be removed again in the reverse direction. The inserted plug connector module is held by the base frame of the plug connector modular frame in a fixed and sturdy manner in the frame plane. In their insertion direction, perpendicular to the frame plane, they are able to latch with their latching lugs in each case between two tabs which are situated opposite one another. The advantage of said design, in principle, is that the plug connector modules are able to be inserted and removed individually without the fastening of the other modules being impaired thereby. The design additionally allows for the plug connector modular frame to consist of metal and consequently enables said protective earthing.

In addition, the modules in such known plug connector modular frames have, in principle, a certain "play", i.e., they are held in the plug connector modular frame with a certain mechanic tolerance. This is also to be seen as necessary for the majority of applications from a technical point of view, at least to a certain extent, as it serves for compensating corresponding tolerances in relation to the counter plug connector during the plugging operation. If said tolerance, however, becomes too large, as is to be observed at times in the case of the last-mentioned prior art, this can result in the fixing of the plug connector modules via the above-mentioned framing parts not meeting the requirements of some industrial fields. Too much play inside the basic body of the plug connector modular frame can namely often also result in excessive insertion and pulling forces when assembling or separating plug connector and counter plug connector. In addition, the contact elements can also tilt as a result, for example during the insertion operation, as a result of which greater friction is additionally also generated and after some time there is possibly even the risk of an overload arc. From a data point of view also, said play can be disadvantageous when using certain data plug connector modules, as, where applicable, said tolerance makes an electronic bus connection considerably more difficult.

All the above-mentioned holding frames are designed to be equipped repeatedly and sometimes with different plug connector modules. Consequently, the holding frame needs to comprise a certain stability and its locking means for the plug connector modules need to comprise a certain durability.

If a holding frame is only to be equipped rarely or even only once with plug connector modules, the holding frames from the prior art are, on the one hand, too complex to operate and, on the other hand, are overqualified technically and too expensive.

BRIEF SUMMARY

Embodiments of the present invention provide a holding frame for plug connectors, more precisely for plug connector modules, or in other words for a plug connector modular frame, which is usable in a flexible manner and is easy to handle. In addition, it is producible in a sturdy and cost-efficient manner.

The holding frame according to embodiments of the invention is provided for use in heavy plug connectors which are also known under the term "industrial plug connectors." Similar and/or different plug connector modules can be inserted reversibly in the holding frames. As a result, a plug connector is able to be assembled in a variable manner according to the area of application and customer wishes. According to embodiments of the invention, the holding frame comprises or consists substantially of at least one, in particular two, in a particularly advantageous manner four, holding frame modules. This means that the holding frame can be assembled from one or multiple elements, that is to say holding frame modules.

In an advantageous design, the holding frame modules are latchable with one another. This provides the advantage of the entire holding frame being able to be adapted to various numbers of plug connector modules without requiring modifications to the product range. As a result, this provides flexibility and low costs for the holding frame.

A particularly advantageous design provides that the holding frame module comprises or consists of at least one punched and/or lasered wall element. Precise cutting edges and clean contours are provided as a result of the punching or lasering process in the production of the wall elements. These offer the advantage of being better able to be combined and/or connected together as the tolerances are smaller than in the case of other production methods. In addition, the production process through the two processes is optimally automatable and consequently also quicker, more efficient and more resource-savings.

In a particularly advantageous design, the holding frame module is formed from at least two jigsaw-piece-like wall elements. The at least two wall elements are connectable together in a sturdy manner as a result of the jigsaw-piece form. In addition, they are thus arbitrarily expandable in dependence on the desired number of plug connector modules. Said variant offers the advantage of only a very small number of variants of wall elements having to be stocked. This reduces costs, increases flexible usability and saves resources.

In an advantageous design, the at least two jigsaw-piece-like wall elements comprise or consist of plastics material and/or metal. Both materials are suitable for the punching and lasering method and provide the holding frame with sufficient stability.

In an advantageous manner, the at least two jigsaw-piece-like wall elements may each comprise at least one molding (or projection) and at least one recess. In some instances, at least one recess and at least one molding are located opposite one another as in the case of a jigsaw piece from a children's jigsaw puzzle. In some instances, the at least one molding is bendable such that it is able to be connected and fixed in a fixed connection to an element arranged at right angles, for example a PE wall. As a result of the bending, the hold against the acting insertion forces is increased as there is a fixed connection between the wall element, or holding frame module, and the element arranged at right angles.

In a further design, the holding frame module is a u-shaped rail. The rail comprises or consists of two parallel legs which are connected together by a connection piece and at the same time are spaced apart from one another. In the case of the u-shaped rail, the two legs of the U are designed to be longer than the connection piece between them. The two legs, in this case, are spaced apart from one another by the connection piece by such a distance that they are suitable as guides for latching lugs of plug connector modules. The two legs are designed with over-dimensioned length so that they can be shortened to the desired, necessary length, corresponding to the number of plug connector modules to be received. This reduces the number of different variants of rails, which consequently ensures reduction in costs for storage and material.

In order to generate a sturdy holding frame, it may be necessary to use two rails which are arranged in parallel and are combined with two elements as end pieces which are arranged at right angles.

An advantageous design of the u-shaped rail provides that it is fixable and lockable by a spring clip. The spring clip can be a u-shaped or rectangular object which comprises elastic properties. The spring clip is slid onto the open end of the rail and thus secures the received plug connector modules from falling out. If the spring clip is also u-shaped, when it is inserted onto the rail the connection piece rests on one of the two legs of the rail and the two legs of the spring clip are arranged perpendicularly to the legs of the rail.

A particular design according to some embodiments provides that the spring clip is designed such that it is able to act at the same time on both of the rails used. Expansion of the spring clip is necessary for this. The expansion is u-shaped. One spring clip, as described above, is arranged on each of the two legs. Said expansion provides the advantage of the two sides of the holding frame not having to be fixed separately from one another, which could result in the received plug connector modules being displaced. In addition, the expansion clearly makes handling easier for a user.

In an advantageous design, the holding frame comprises a fixing means or device and is stabilizable as a result. The fixing means or device serves for securing and stabilizing the received plug connector modules, as well as the holding frame modules and possible wall elements.

In some instances, the fixing means or device is a cable tie or an auxiliary frame or a belt. The fixing means or device is designed such that it is able to encompass a loaded holding frame. It extends, in this case, along the holding frame modules or the wall elements, that is to say perpendicularly to the insertion direction of the holding frame. The use of cable ties or a belt has the advantage of them being individually adaptable to the circumference of the holding frame, which results in low storage costs on the basis of the small variant variety.

In some instances, the auxiliary frame comprises or consists of plastics material or metal. As a result, it is able to be produced in a cost-efficient manner. Compared to the cable tie or the belt, the auxiliary frame offers the advantage of being equally sturdy and additionally being simple for a user to mount as it only has to be slid over the holding frame.

In an advantageous design, the holding frame comprises at least one PE wall with a connection for protective earthing and at least one means or device for fastening. The PE wall serves for the connection of the protective earthing and is necessary in some applications. The PE wall is ideally arranged at right angles to the at least one holding frame module. Proceeding from a quadrangular, in a particularly advantageous manner rectangular or square, holding frame, the PE wall forms in each case two oppositely situated, parallel sides. The two remaining, parallel sides are formed in each case by at least one holding frame module. In addition, the holding frame comprises at least one other means or device for fastening which serves for mounting the holding frame in a plug connector housing.

In a particularly advantageous design, the PE wall comprises or consists of a metal. As a result, in the case of the connection of a protective earthing to the PE wall, such is able to be achieved without further auxiliary means or devices. A design of the PE wall from plastics material is also conceivable, however this is only suitable in conjunction with metal elements fixed thereon as the connection of the protective earthing.

In an advantageous manner, the PE wall is producible using a punching and bending method or a casting method. This simplifies the production process which consequently saves costs.

In some instances, the connection for protective earthing is a PE contact. As a result, a protective conductor is easy to connect for a user and the necessary protective earthing is ensured in a reliable manner.

An advantageous design provides that the means or devices for fastening are screws, rivets, bolts, pins or similar, wherein the means or devices for fastening serves for mounting the holding frame in a plug connector housing. The term "similar" refers to all fastening means or devices not mentioned here which fulfill functions analogous to the named fastening means or devices and which are able to fix the holding frame in a corresponding manner.

BRIEF DESCRIPTION OF THE SEVERAL VIEWS OF THE DRAWINGS

Exemplary embodiments of the invention are shown in the drawings and are explained in more detail below. The drawings are as follows.

The figures may include partially simplified, schematic representations. In part, identical reference symbols are used for similar, but where applicable not identical elements. Different views of similar elements could be scaled differently.

DETAILED DESCRIPTION

Figure 1:
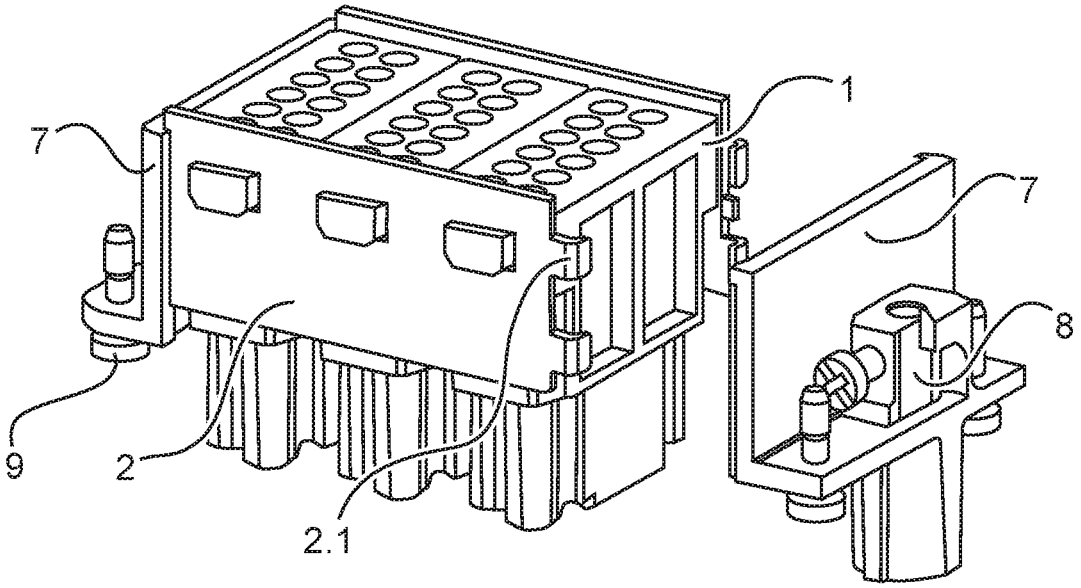
FIG. 1 shows a perspective representation of a holding frame according to one example embodiment of the invention with two holding frame modules.
Figure 2:
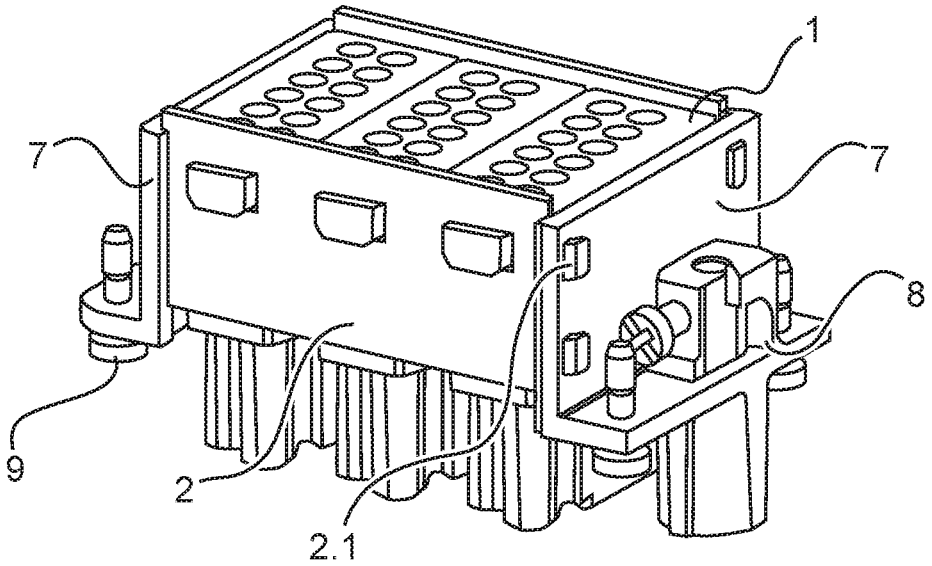
FIG. 2 shows a perspective representation of the holding frame according to the example embodiment of the invention with two holding frame modules and PE walls.

FIGS. 1 and 2 each show a perspective representation of a holding frame according to one example embodiment of the invention with two holding frame modules 2 and three received plug connector modules 1.

The number of plug connector modules 1 is only an example in each of the figures. For better clarity, only one component of the holding frame is provided in each case with a reference symbol even if multiple similar type components are installed.

The difference between the two figures lies in the PE wall 7. Two PE walls 7 are installed per holding frame. In FIG. 1, however, only one PE wall 7 is completely mounted, the second PE wall 7, however, not yet. Consequently, FIG. 1 shows an unfinished holding frame, FIG. 2 a completely loaded holding frame.

The holding frame comprises or consists in both figures of two parallel holding frame modules 2 which are situated opposite one another. The holding frame modules 2 are punched or lasered metal elements which each comprise recesses for latching lugs of plug connector modules 1. Each recess is formed in each case corresponding to the contour of the latching lug of the plug connector module 1.

On each of the two sides, the holding frame module 2 comprises at least one tab 2.1, here two tabs 2.1 in each case. In this case, the tabs 2.1 are arranged such that they are able to interact and latch with the respective PE wall 7. The PE wall 7 comprises corresponding recesses for the latching, as can be seen in FIG. 2.

Whilst in FIG. 1 only one PE wall 7 is already latched with the two holding frame modules 2, in FIG. 2 both PE walls 7 are. The holding frame obtains its optimum stability as a result of said latching with the holding frame modules 2 and the inserted plug connector modules 1.

The PE wall 7 comprises or consists in all figures, that is to say FIG. 1 to FIG. 5, of a wall which is formed in a preferred manner from metal or from plastics material with a metal molding for ensuring conductivity. In addition, the PE wall comprises a connection for protective earthing 8 and at least one, here two, means or devices for fastening 9.

The connection for protective earthing 8 is a PE contact, as is sufficiently disclosed and prescribed in the prior art.

The means or devices for fastening 9 in all figures is a screw, more precisely two screws per PE wall 7. By way of the screws, the holding frame is able to be mounted into a plug connector housing without a user needing a special tool.

Figure 3:
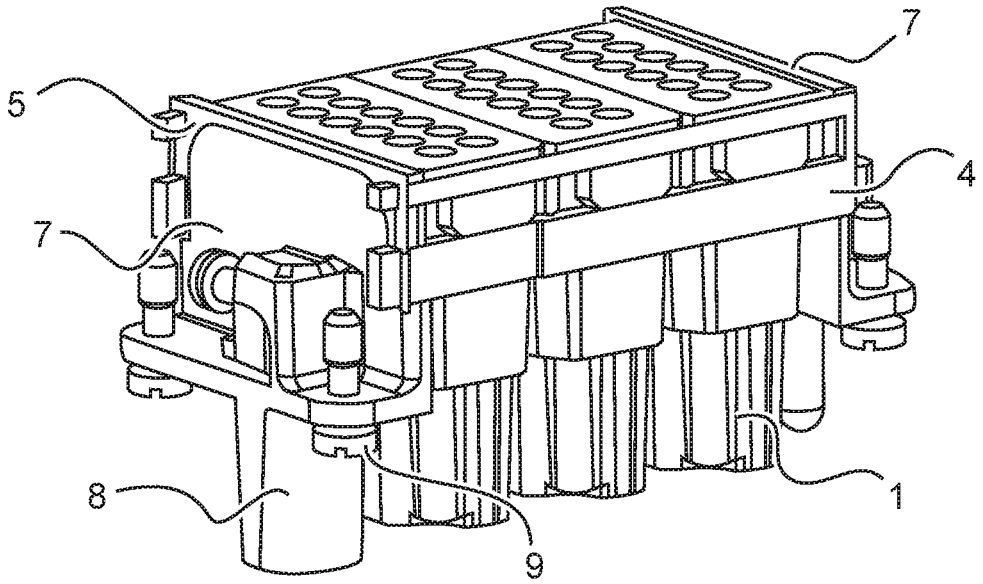
FIG. 3 shows a perspective representation of a holding frame according to another example embodiment of the invention with two rails.

FIG. 3 shows a further embodiment of a holding frame according to the invention. In said figure the holding frame comprises two rails 4 along with the two PE walls 7 and the three received plug connector modules 1. In said variant, the two rails 4 replace the two holding frame modules 2 from FIGS. 1 and 2.

The rails 4 are in each case a u-shaped rail. It comprises in each case two parallel, long legs which are connected by a comparatively shorter connection piece. The connection piece provides the necessary spacing between the two legs. The spacing, in this case, is designed such that the latching lugs of the plug connector modules 1 are able to be received and securely held between the two legs of the rails 4. The length of the rails 4 is designed to be overlong in comparison to the legs and can be shortened as required, in other words in dependence on the number of received plug connector modules, here three. The open ends of the two rails 4 are fixed and locked in FIG. 3 by a spring clip 5.

The spring clip 5 is a u-shaped object with elastic properties which corresponds in its form to a rail 4, in other words also comprises two parallel legs and an associated connection piece. The spring clip 5 is slid onto the open end of the respective rail 4 and thus secures the received plug connector modules 1 from falling out. In this case, when said spring clip 5 is inserted onto the rail 4, the connection piece of the spring clip 5 rests on one of the two legs of the rail 4 and the two legs of the spring clip 5 are arranged perpendicularly to the legs of the rail 5.

FIG. 3 shows a particular design of the spring clip 5, namely an expansion of the described spring clip 5. The spring clip 5 is designed here such that it is able to act at the same time on both the rails 4 that are used. The expansion is formed like a U. A spring clip 5, as described above, is arranged in each case on the two legs of the expansion. As a result, both rails 4 are able to be fixed and locked at the same time.

Figure 4:
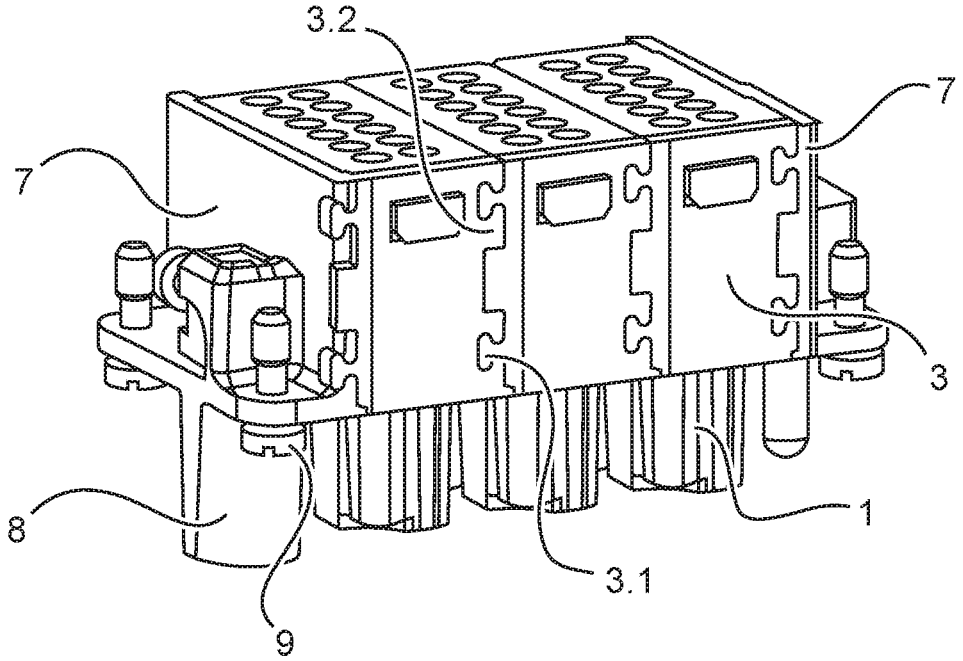
FIG. 4 shows a perspective representation of a holding frame according to another example embodiment of the invention with jigsaw-piece-like wall elements.

FIG. 4 shows a further embodiment of a holding frame according to the invention. Here, the difference to the embodiments of the previous figures is that the holding frame modules 2 are in multiple parts. Each holding frame module 2 comprises or consists of individual wall elements 3. In each case, there are three wall elements 3 per holding frame module 2 in FIG. 4. Here the wall elements 3 serve as connection between the two PE walls 7.

Each wall element 3 is designed in a jigsaw-piece-like manner. That is to say, it comprises at least one molding 3.1 and at least one recess 3.2. In the present exemplary embodiment, each wall element 3 comprises three moldings 3.1 and three recesses 3.2. In this case, two moldings 3.1 (or projections) or two recesses 3.2 evoke the forms of a jigsaw piece, whilst one molding 3.1 or one recess 3.2 is designed in a rectangular manner and is arranged between the two moldings 3.1 or recesses 3.2. The moldings 3.1 and the recesses 3.2 are designed such that they ensure a simply generatable connection without auxiliary means or devices between two wall elements 3.

In order to increase the stability of the entire holding frame even more, the PE walls 7 also comprise, in said exemplary embodiment, corresponding moldings or recesses which are latched with the moldings 3.1 and the recesses 3.2 of the wall elements 3. As an alternative to this, the moldings 3.1 could also be designed in a flexible manner, analogously to the tabs 2.1 from FIGS. 1 and 2.

Figure 5:
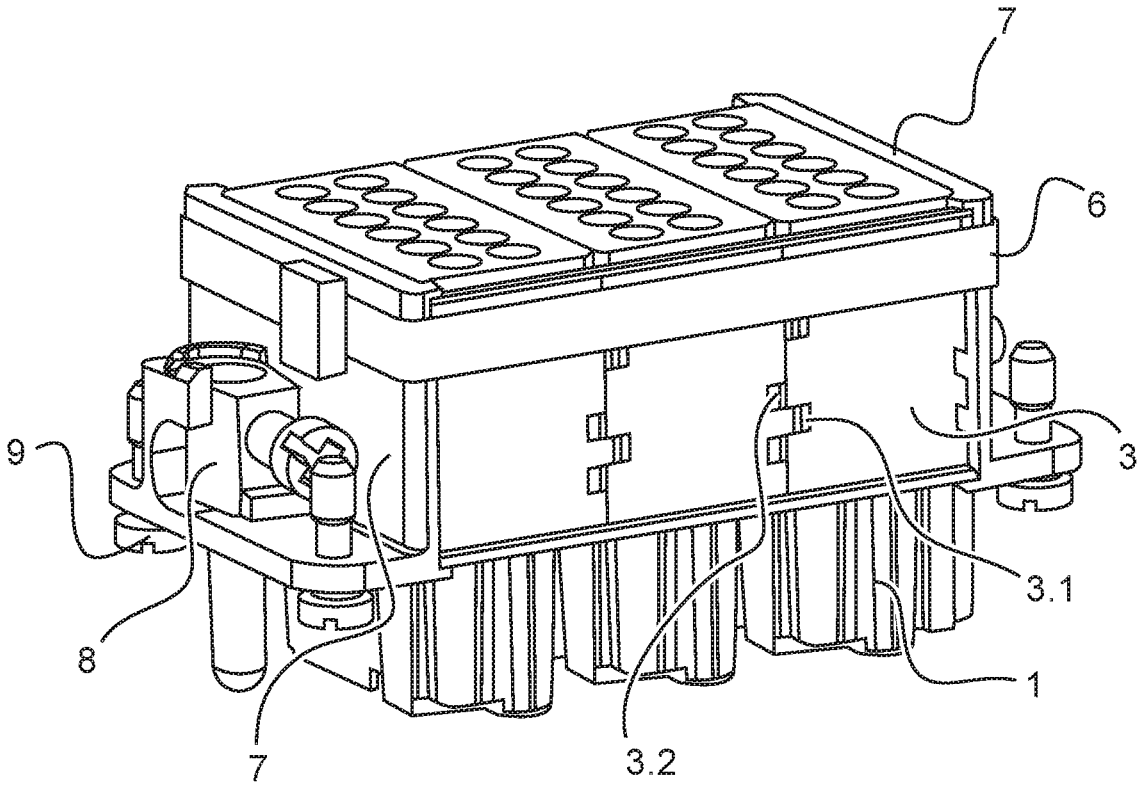
FIG. 5 shows a perspective representation of a holding frame according to another example embodiment of the invention with wall elements and fixing means or devices.

FIG. 5 shows a further embodiment with aspects similar to the embodiment of FIG. 4. Here too, the holding frame module 2 comprises or consists of three wall elements 3. Said wall elements 3 are also latched together by means or devices of moldings 3.1 and recesses 3.2. However, the moldings 3.1 and the recesses 3.2 are designed as geometric figures instead of as a rectangle and as a jigsaw piece.

In addition for increasing the stability, the holding frame comprises a fixing means or device 6. This may be a cable tie which has been placed circumferentially about the completely loaded holding frame and tensioned. As a result of the fixing means or device, the PE walls 7, the wall elements 3 and the plug connector modules 1 are connected fixedly and securely to one another.

The fixing means or device 6 is not only able to be used with the holding frame embodiment according to FIG. 4 but is also suitable for use in combination with the other holding frame embodiments according to FIGS. 1 to 3.

Even if different aspects or features of the invention are shown in each case in combination in the figures, it is apparent to the expert—insofar as nothing to the contrary is stated—that the combinations shown and discussed are not the only possible ones. In particular, units or feature complexes which correspond to one another from different exemplary embodiments are able to be exchanged with one another.

Moreover, various features and aspects of the embodiments described above may be combined to provide further embodiments. In addition, the foreign patent application listed in the Application Data Sheet, namely, German patent application DE 10 2017 125 859.0, filed Nov. 6, 2017, is incorporated herein by reference in its entirety. Aspects of the embodiments can be modified, if necessary, to employ concepts of the application to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame for plug connectors, in particular for receiving similar and/or different plug connector modules, the holding frame comprising:

a rectangular frame structure including a plurality of holding frame modules and a plurality of opposing end parts separate and distinct from the plurality of holding frame modules, the plurality of holding frame modules being removably coupled to the plurality of opposing end parts to define an interior cavity adapted to receive the plug connector modules, and the holding frame modules extending between the plurality of opposing end parts to define longitudinal sides of the rectangular frame structure.

2. The holding frame as claimed in claim 1, wherein the holding frame modules and the opposing end parts are latchable together.

3. The holding frame as claimed in claim 1, wherein each holding frame module consists of at least one punched and/or lasered wall element.

4. The holding frame as claimed in claim 1, wherein each holding frame module is formed from at least two jigsaw-piece-like wall elements that couple together side-by-side to extend a full length of the rectangular frame structure.

5. The holding frame as claimed in claim 4, wherein the at least two jigsaw-piece-like wall elements consist of plastics material and/or metal.

6. The holding frame as claimed in claim 4, wherein the at least two jigsaw-piece-like wall elements each comprise at least one molding and at least one recess.

7. The holding frame as claimed in claim 1, wherein each holding frame module is a u-shaped rail having legs that extend in a longitudinal direction from one of the opposing end parts toward the other one of the opposing end parts.

8. The holding frame as claimed in claim 7, further comprising a spring clip, and wherein the u-shaped rail is fixable and lockable by the spring clip.

9. The holding frame as claimed in claim 1, wherein the holding frame further comprises a fixing device that surrounds the rectangular frame structure and stabilizes the holding frame.

10. The holding frame as claimed in claim 9, wherein the fixing device is a cable tie or a circumferential auxiliary frame or a belt.

11. The holding frame as claimed in claim 10, wherein the fixing device is a circumferential auxiliary frame and wherein the circumferential auxiliary frame consists of plastics material or metal.

12. The holding frame as claimed in claim 1, wherein at least one of the end parts of the rectangular frame structure comprises a PE wall with a connection for protective earthing and at least one means for fastening.

13. The holding frame as claimed in claim 12, wherein the PE wall consists of a metal.

14. The holding frame as claimed in claim 12, wherein the PE wall is producible using a punching and bending method or a casting method.

15. The holding frame as claimed in claim 12, wherein the connection for protecting earthing is a PE contact.

16. The holding frame as claimed in claim 12, wherein the means for fastening are screws, rivets, bolts, pins or similar fasteners, and wherein the means for fastening serves for mounting the holding frame in a plug connector housing.

* * * * *